US008845041B2

(12) United States Patent
Jung et al.

(10) Patent No.: US 8,845,041 B2
(45) Date of Patent: Sep. 30, 2014

(54) WASHING MACHINE

(75) Inventors: Jin Il Jung, Suwon-si (KR); Yeong Man Kim, Suwon-si (KR); Sam Young Jang, Yongin-si (KR); Yong Kwon Won, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 77 days.

(21) Appl. No.: 13/600,754

(22) Filed: Aug. 31, 2012

(65) Prior Publication Data

US 2013/0057129 A1 Mar. 7, 2013

(30) Foreign Application Priority Data

Sep. 5, 2011 (KR) ..... 10-2011-0089427

(51) Int. Cl.
*A47B 77/06* (2006.01)
*D06F 39/12* (2006.01)
*D06F 23/04* (2006.01)

(52) U.S. Cl.
CPC ..... *D06F 23/04* (2013.01); *D06F 39/12* (2013.01)
USPC ..... 312/228

(58) Field of Classification Search
USPC ..... 312/228; 34/595, 605; 403/283; 68/3 R, 68/134; 29/525.01
See application file for complete search history.

(56) References Cited

U.S. PATENT DOCUMENTS

| | | | | | |
|---|---|---|---|---|---|
| 3,347,609 | A | * | 10/1967 | Mann | 312/263 |
| 4,781,337 | A | * | 11/1988 | Corby et al. | 242/348.4 |
| 4,798,424 | A | * | 1/1989 | Coates et al. | 312/257.1 |
| 5,358,323 | A | * | 10/1994 | Ripley | 312/228 |
| 7,434,304 | B2 | * | 10/2008 | Owens | 29/525.01 |
| 7,726,157 | B2 | * | 6/2010 | Lim et al. | 68/3 R |
| 2005/0103061 | A1 | * | 5/2005 | Kim | 68/5 E |
| 2007/0111593 | A1 | * | 5/2007 | Kim | 439/536 |

FOREIGN PATENT DOCUMENTS

| | | | |
|---|---|---|---|
| JP | 61-196997 | * | 9/1986 |
| KR | 1998-018954 | | 7/1998 |
| KR | 1998-065899 | | 12/1998 |
| KR | 2000-0002277 | | 2/2000 |

* cited by examiner

*Primary Examiner* — Matthew Ing
(74) *Attorney, Agent, or Firm* — Staas & Halsey LLP

(57) ABSTRACT

A washing machine having a coupling structure configured to economically and strongly couple component parts to each other, the washing machine including a frame forming an exterior, an upper cover coupled to an upper portion of the frame and provided with an opening unit to which a laundry is introduced, an electronic part accommodating plate coupled to an rear portion of the upper cover, and a connection unit provided at the electronic part accommodating plate and extended toward a lower direction from a lower portion of the electronic part accommodating plate.

18 Claims, 8 Drawing Sheets

WASHING MACHINE

CROSS-REFERENCE TO RELATED APPLICATIONS

This application claims the priority benefit of Korean Patent Application No. 10-2011-0089427, filed on Sep. 5, 2011 and No. 10-2011-0116909, filed on Nov. 10, 2011 in the Korean Intellectual Property Office, the disclosures of which are incorporated herein by reference.

BACKGROUND

1. Field

Embodiments of the present disclosure relate to a washing machine having a connecting structure between a frame and an electronic part accommodating plate provided with various electronic parts positioned thereon.

2. Description of the Related Art

Generally, a washing machine, according to a washing method, is divided into a pulsator type washing machine and a drum type washing machine. For a pulsator type washing machine, a washing tub, at which a washing takes place, is provided with a rotating shaft formed in perpendicular to a ground.

A pulsator type washing machine includes a housing, a water tub installed at an inside the housing, and a rotating tub rotatively installed at an inside the water tub. A pulsator configured to generate a water flow of a washing water is installed at a lower portion of the rotating tub.

The pulsator type washing machine, when a rotating tub and a pulsator rotate by a motor in a state that a laundry and a washing water are introduced at an inside the rotating tub, by stirring the laundry and the washing water introduced to the inside the rotating tub, removes a stain from the laundry.

A washing machine as the above includes a frame configured to form an exterior of the washing machine and fix and support various parts at an inside therein, and an upper cover coupled to an upper portion of the frame. An electronic part accommodating plate may be installed at the upper cover. The electronic part accommodating plate is provided with a control apparatus and various electronic parts configured to control the operation of the washing machine.

A coupling structure is formed between the parts forming a washing machine, and the forming of an economical and strong coupling structure between the parts having different material quality is important.

In order to couple an electronic part accommodating plate and a frame, a separate bracket may be used, and a screw may be needed in addition to the separate bracket. In such case, the number of parts may increase, and quality of assembly may also be adversely affected.

SUMMARY

Therefore, it is an aspect of the present disclosure to provide a washing machine having a coupling structure configured to economically and strongly couple component parts to each other.

Additional aspects of the disclosure will be set forth in part in the description which follows and, in part, will be apparent from the description, or may be learned by practice of the disclosure.

In accordance with one aspect of the present disclosure, a washing machine includes a frame, an upper cover, an electronic part accommodating plate, and a connection unit. The frame forms an exterior. The upper cover is coupled to an upper portion of the frame and provided with an opening unit to which a laundry is introduced. The electronic part accommodating plate is coupled to an rear portion of the upper cover. The connection unit is provided at the electronic part accommodating plate and extended toward a lower direction from a lower portion of the electronic part accommodating plate.

The connection unit may be provided with at least one connection unit hole which is coupled to the frame.

The connection unit hole may include a connecting hole to couple with the frame and at least one reserve connecting hole provided in case when the connecting hole is damaged.

The reserve connecting hole may be initially closed to be distinguished from the connecting hole.

A rib configured to support the weight of the frame is provided at an inside the connection unit.

The washing machine may further include a guide unit configured to guide a coupling position of a coupling member that couples the connection unit to the frame.

The guide unit may include a position determining protrusion provided at the connection unit and a position determining groove provided at the frame.

A rear surface of the position determining protrusion is recessed toward an inner side to guide the coupling position of the coupling member, and the position determining groove, while coupled to the position determining protrusion in a corresponding manner to each other, is punctured by the coupling member.

The connection unit is provided at both edges of the electronic part accommodation plate.

The connection unit is further provided at a central portion of the electronic part accommodating plate.

The connection unit is integrally injection-molded with the electronic part accommodating plate.

In accordance with another aspect of the present disclosure, a washing machine having a frame forming an exterior and an upper cover, which is coupled to an upper portion of the frame and provided with an opening unit to which a laundry is introduced, the washing machine includes an electronic part accommodating plate and at least one connection unit. The electronic part accommodating plate is coupled to a rear portion of the upper cover. The at least one connection unit is provided at the electronic part accommodating plate and extended toward a lower direction from the electronic part accommodating plate.

The at least one connection unit is provided at both edges of the electronic part accommodating plate.

The at least one connection unit is provided at a central portion of the electronic part accommodating plate.

The at least one connection unit is provided at an inside thereof with at least one connection unit hole which is coupled to a coupling member that is configured to couple the electronic part accommodating plate to the frame.

The at least one connection unit hole includes a connecting hole coupled to the coupling member, and a reserve connecting hole provided in case when the connecting hole is damaged. The reserve connecting hole may be initially closed to be distinguished from the connecting hole.

A position determining protrusion is provided at the connection unit to guide a coupling position of the coupling member that couples the connection unit to the frame, and a position determining groove is provided in the frame, wherein the position determining groove, while coupled to the position determining protrusion in a corresponding manner to each other, is punctured by the coupling member.

In accordance with the embodiments of the present disclosure, by offering an economical and strong connecting structure of component parts, the number of assembly parts may be reduced and the quality of assembly may be enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
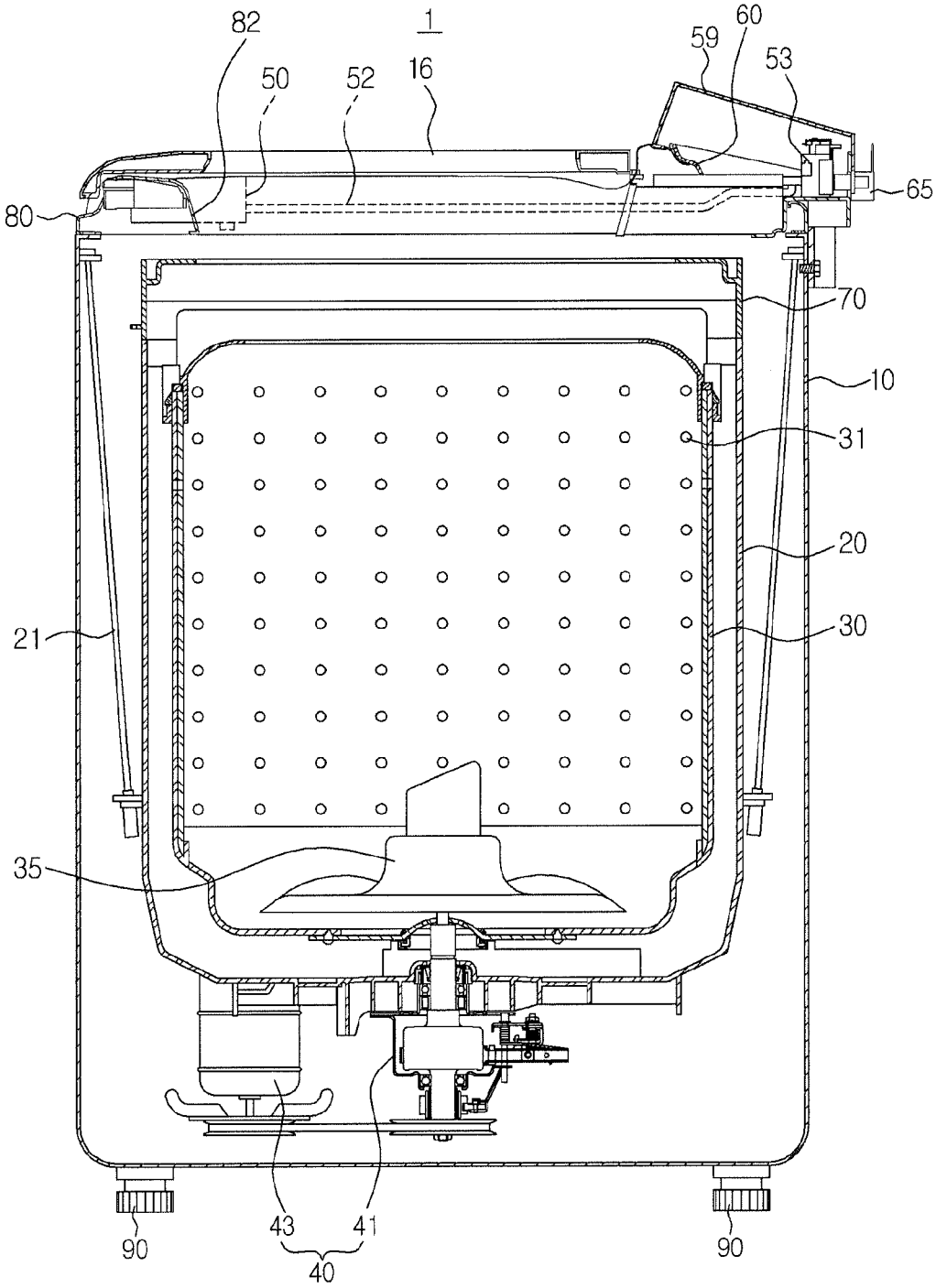
FIG. 1 is a cross-sectional view of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a washing machine in accordance with an embodiment of the present disclosure.

As illustrated on FIG. 1, a washing machine 1 includes a frame 1 forming an exterior, a tub 20 disposed at an inside the frame 10, a rotating tub 30 rotatively installed at an inside the tub 20, and a driving apparatus 40 disposed at an lower portion of the tub 20 to drive the rotating tub 30.

An upper cover 91 provided with an opening unit 92 thereon is coupled to an upper portion of the frame 10 to introduce a laundry to an inside the rotating tub 30. A door 16 is coupled to the upper cover 91 to open/close the opening unit 92, and a detergent container 50 to supply a detergent to an inside the tub 20 is coupled to a lower portion of the upper cover 91.

A suspension apparatus 21 is connected to an outer side of the tub 20 to hang and support the tub 20 to the body 10, and a tub cover 70 having a ring shape is coupled to an upper end of the tub 20 to cover the tub 20.

The rotating tub 30 is rotatively disposed at an inside the tub 20 and is provided with a plurality of vent holes 31. A pulsator 35 is rotatively installed at a bottom of the rotating tub 30, and the pulsator 35 is configured to stir the laundry introduced to an inside the rotating tub 30 along with a washing water.

The driving apparatus 40 includes a clutch 41 to rotate the rotating tub 30 and the pulsator 35, and a driving motor 43 to drive the clutch 41. The driving motor 43 is connected to the clutch 41 by a pulley (not shown) and a belt (not shown), and conveys the driving force to the rotating tub 30 and the pulsator 35.

A water supply valve 53 is installed at an upper portion of the tub 20, and the water supply valve 53 and the detergent container 50 are connected to each other through a water supply hose 52. The water supplied through the water supply valve 53 is supplied to the detergent container 50 through the water supply hose 52, and the water supplied to the detergent container 50 is introduced to an inside the tub 20 along with the detergent.

The frame 10 may be formed with a steel plate, and a leg unit 90 is provided at a lower portion of the frame 10 to support the washing machine to be supported on a ground surface.

Figure 2:
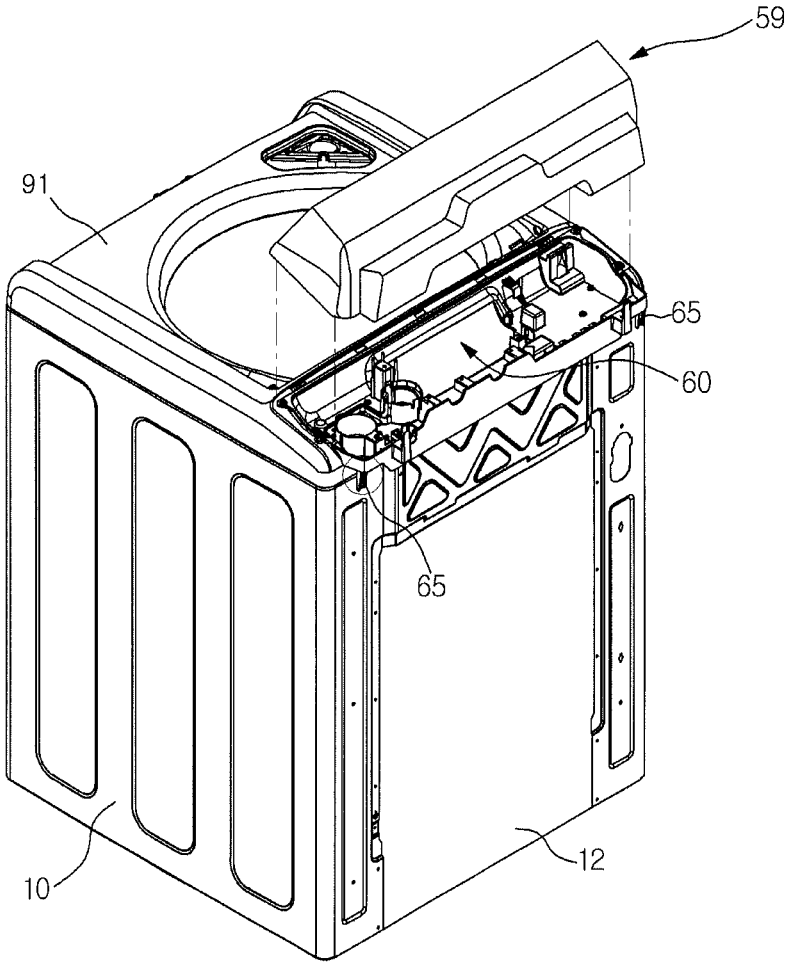
FIG. 2 is a perspective view illustrating a state of a frame and an upper cover coupled to each other according to the embodiment of the present disclosure.
Figure 3:
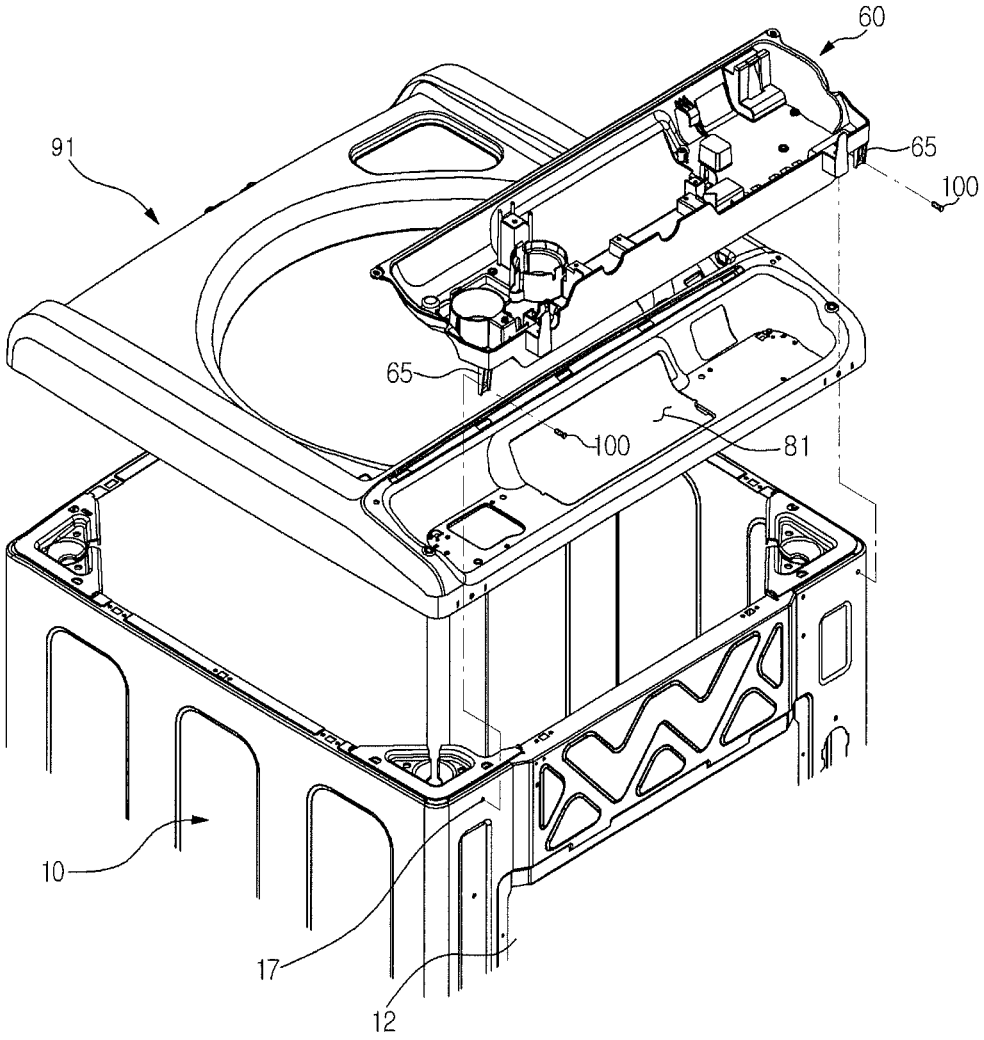
FIG. 3 is an exploded perspective view of a frame, an upper cover, and an electronic part accommodating plate according to the embodiment of the present disclosure.
Figure 4:
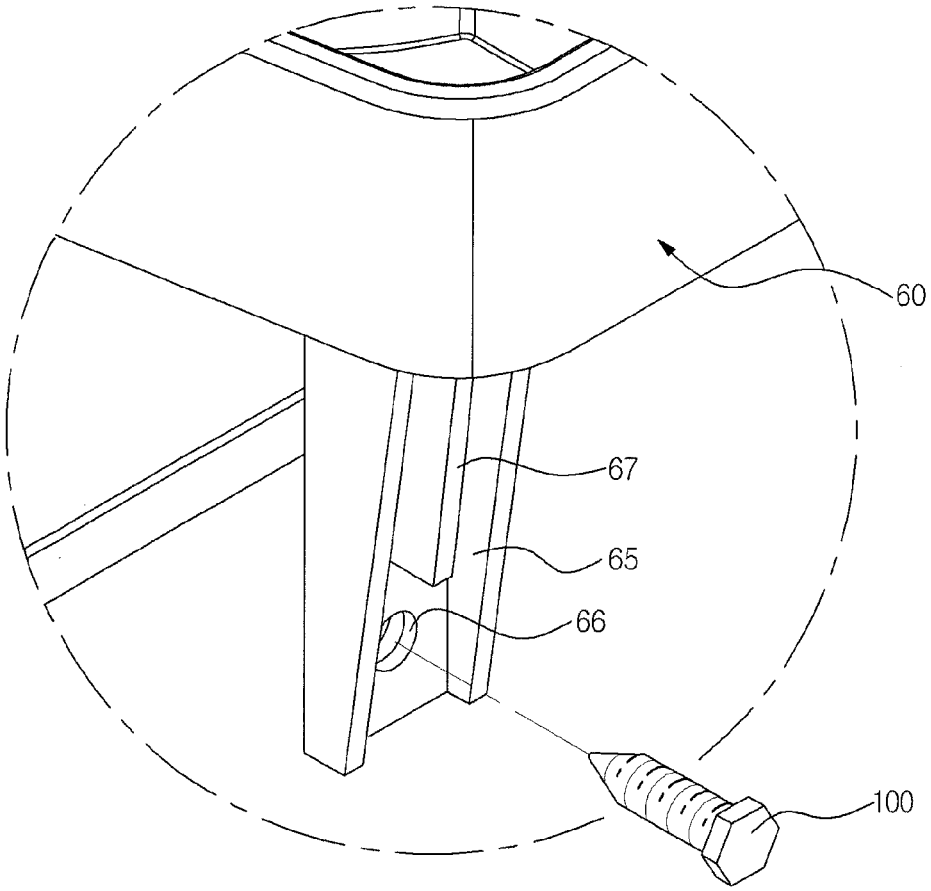
FIG. 4 is an enlarged perspective view illustrating a connection unit according to the embodiment of the present disclosure.

FIG. 2 is a perspective view illustrating a state of a frame and an upper cover coupled to each other in accordance with the embodiment of the present disclosure. FIG. 3 is an exploded perspective view of a frame, an upper cover, and an electronic part accommodating plate according to the embodiment of the present disclosure. FIG. 4 is an enlarged perspective view illustrating a connection unit in accordance with the embodiment of the present disclosure.

As illustrated on FIGS. 2 to 4, various electronic components, which are related to the operation of the washing machine 1, such as a control apparatus (not shown), the water supply valve 53 (see FIG. 1), and a noise filter (not shown), are installed at a rear portion of the upper cover 91 that is an adjacent portion to a rear frame 12. In addition, an electronic part accommodating plate 60 configured to accommodate the electronic part component as the above is installed.

A cover member 59 is installed at an upper portion of the electronic part accommodating plate 60 to prevent moist substance such as washing water, etc from being introduced to the electronic part accommodating plate 60. In addition, a structure to guide the installation of each part is provided at an upper portion of the electronic part accommodating plate 60. Such a structure may be manufactured through injection-molding of resin.

The upper cover 91 may be formed with metallic material such as stainless steel, or with injection-molded material including resin, as in the electronic part accommodating plate 60. In addition, the rear portion of the upper cover 91 is recessed to form an accommodating space 81 at which the electronic part accommodating plate 60 may be accommodated and installed.

The electronic part accommodating plate 60, while being accommodated at the accommodating space 81, is coupled to a rear surface of the frame 10. A connection unit 65 is provided at the electronic part accommodating plate 60 to be coupled to the frame 10. The connection unit 65 is extended toward a lower direction from an upper portion of the rear surface of the electronic part accommodating plate 60. That is, the connection unit 65 is extended toward an upper portion of the rear surface of the frame 10 from a lower portion of the rear surface of the electronic part accommodating plate 60.

The connection unit 65 may be formed in a pair at both sides of the rear surface of the electronic part accommodating plate 60, and may also be formed in plurality. In addition, the connection unit 65 may be positioned at a central portion of the electronic part accommodating plate 60. A rib 67 may be provided at an inner side of the connection unit 65 to enforce the strength of the electronic part accommodating plate 60.

At least one connection unit hole 66 is provided at the connection unit 65 for the connection unit 65 to be coupled to the frame 10. A coupling member 100 is coupled to the connection unit hole 66 such that the connection unit 65 is coupled to the frame 10.

The connection unit 65 may be integrally injection-formed with the electronic part accommodating plate 60. A screw may be used as the coupling member 100, but not limited hereto.

Although a frame hole 17 to which the coupling member 100 is coupled is shown at a rear surface of the frame 100 in the drawing, the frame hole 17 may be omitted. A tab may be formed, as the assembly position of the frame 10 is punctured by the coupling member 100 during the coupling process of the coupling member 100 while the frame hole 17 is not formed. Alternatively, the coupling member 100 may be coupled to the frame 10 in a state that the frame hole 17 is provided at the frame 10 in advance.

The coupling of the coupling member 100 through the connection unit 65 may be achieved at a single site on the rear surface of the frame 10, and the coupling member 100 may not be coupled between the connection unit 65 and the upper cover 91.

An additional coupling structure such as a hook connection or a screw connection may be provided between the upper cover 91 and the electronic part accommodating plate 60. In a state that the electronic part accommodating plate 60 is initially coupled to the upper cover 91, when the coupling member 100 is coupled between the connection unit 65 and the frame 10, the upper cover 91 disposed between the electronic part accommodating plate 60 and the frame 10 is pressed downward, thereby forming a coupling force between the electronic part accommodating plate 60 and the upper cover 91 and between the electronic part accommodating plate 60 and the frame 10. That is, when a screw is coupled to each connection unit 65, the electronic part accommodating plate 60 and the upper cover 91 have a coupling force with respect to the frame 10, thereby enhancing the assembly among the parts.

Figure 5:
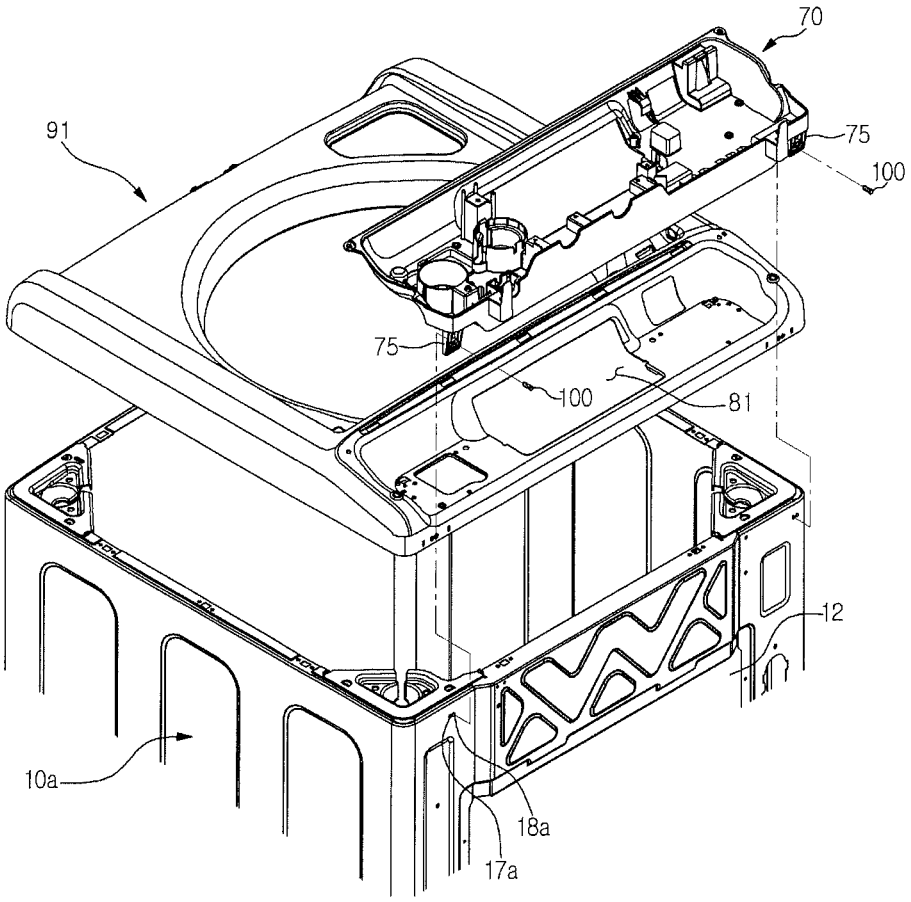
FIG. 5 is an exploded perspective view of a frame, an upper cover, and an electronic part accommodating plate according to another embodiment of the present disclosure.
Figure 6:
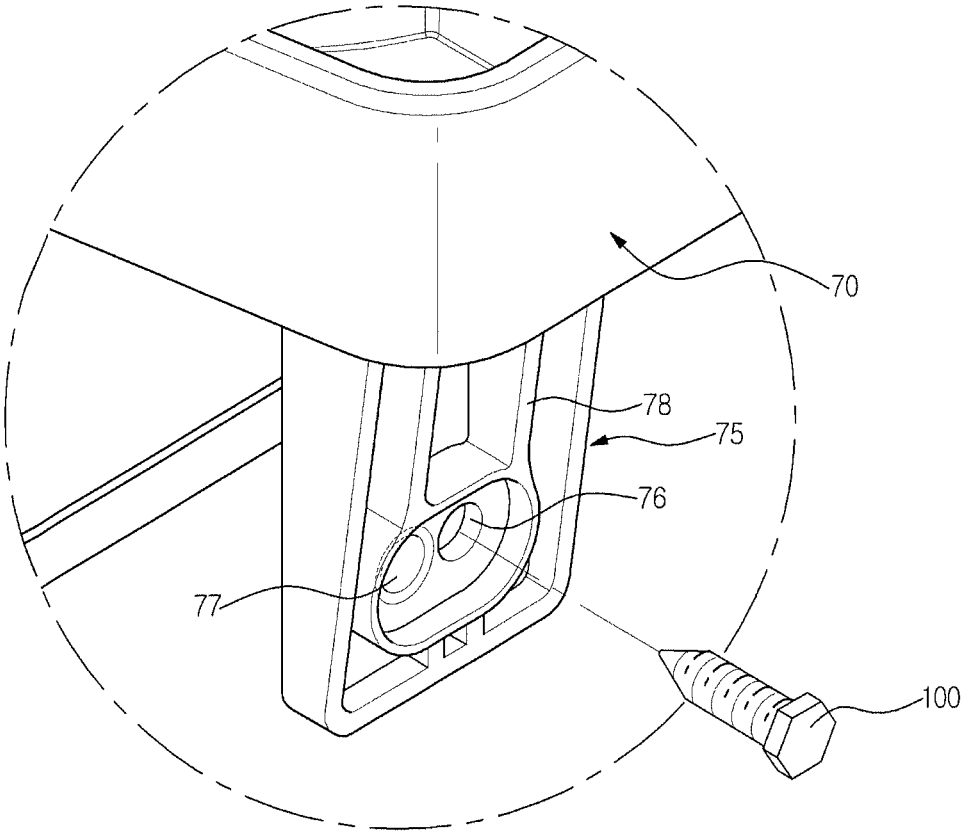
FIG. 6 is an enlarged perspective view illustrating a connection unit of FIG. 5.

FIG. 5 is an exploded perspective view of a frame, an upper cover, and an electronic part accommodating plate according to another embodiment of the present disclosure. FIG. 6 is an enlarged perspective view illustrating a connection unit of FIG. 5.

As illustrated on FIGS. 5 to 6, a connection unit 75 may be provided with at least one of connection unit hole, for example, connection unit holes 76 and 77. The connection unit holes 76 and 77 may include a connection hole 76 configured to be coupled to a frame 10*a* and at least one reserve connection hole 77 provided to be coupled to the frame 10*a* the connection hole 76 is damaged. Since the connection unit 75 is integrally provided with an electronic part accommodating plate 70, the reserve connection hole 77 is provided to prevent the inconvenience in replacing the entire electronic part accommodating plate 70 in case when the connection hole 76 is damaged.

In addition, the reserve connection hole 77 is injection-molded and is closed initially, such that the reserve connection hole 77 is distinguished from the connection hole 76 during the assembly of the coupling member 100. When the reserve connection hole 77 is needed to be used as the connection hole 76 is damaged, since the injection-molded material covering the reserve connection hole 77 is not thick, the injection-molded material is punctured by the coupling member 100, and the reserve connection hole 77 is penetrated.

Frame holes 17*a* and 18*a*, in preparation for the use of the reserve connection hole 77 in connecting the coupling member 100, may be provided at the frame 10*a* at a position corresponding to the connection hole 76, as well as at a position corresponding to the reserve connection hole 77. However, a tab may be formed, as the frame 10*a* is punctured by the coupling member 100 in the coupling process of the coupling member 100 while frame holes are not provided separately.

In addition, in accordance with the embodiment of the present disclosure illustrated on FIGS. 5 to 6, a rib 78 may be provided at an inner side of the connection unit 75, while having the connection hole 76 and the reserve connection hole 77 as a center, to prevent the connection unit 75 from being damaged as the strength of the connection unit 75 is weakened as a result of the reserve connection hole 77 provided therein.

Figure 7:
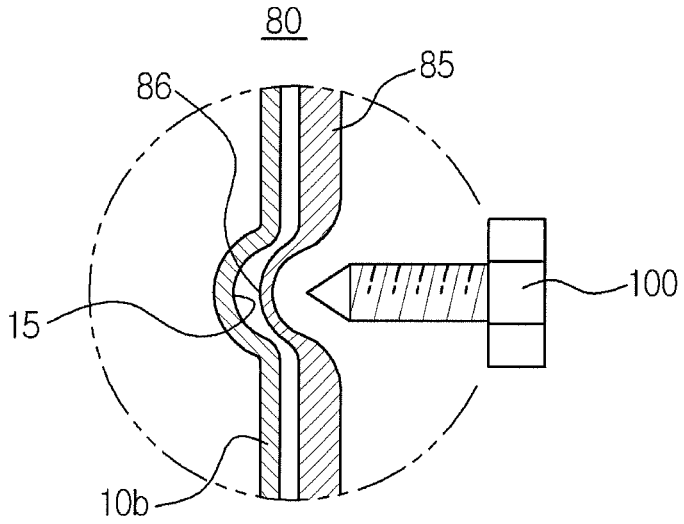
FIG. 7 is an enlarged perspective view illustrating a state of a connection unit and a rear surface frame prior to a coupling member being coupled thereto according to another embodiment of the present disclosure.
Figure 8:
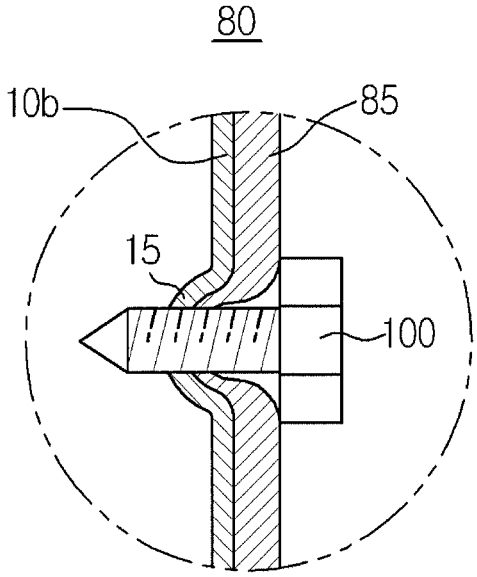
FIG. 8 is an enlarged perspective view illustrating a state of the coupling member coupled to the connection unit and the rear surface frame of FIG. 7.

FIG. 7 is an enlarged perspective view illustrating a state of a connection unit and a rear surface frame prior to a coupling member being coupled thereto according to another embodiment of the present disclosure. FIG. 8 is an enlarged perspective view illustrating a state of the coupling member coupled to the connection unit and the rear surface frame of FIG. 7.

In the case of the embodiments illustrated on FIGS. 7 to 8, a connection unit 85 is fixed at a frame 10*b* through the coupling of the coupling member 100, as the embodiments illustrated on FIGS. 1 to 6, except that a guide unit 80 is included therein.

A proper coupling position of the coupling member 100 between the connection unit 85 and the frame 10*b* is guided through the guide unit 80.

The guide unit 80 includes a position determining protrusion 86 and a position determining groove 15. The position determining protrusion 86 is provided at the connection unit 85, and the position determining groove 15 is provided at the frame 10*b*. The position determining protrusion 86 and the position determining groove may have shapes corresponding to each other to easily guide the coupling of the coupling member 100 to the frame 10*b*.

The position determining protrusion 86, may be protruded in a curved shape, for example, a semi-sphere shape, is provided at a rear surface of the connection unit 85, and the position determining groove 15, may be recessed in a curved shape, for example, a semi-sphere shape, is provided at a proper position at a rear surface of the connection unit 85 such that the connection unit 85 and the coupling member 100 are be coupled to each other.

Therefore, an assembler confirms that the position determining protrusion 86 is coupled to the position determining groove 15, and then allows the coupling member 100 to be penetrated at the position determining protrusion 86 and the position determining groove 15, thereby coupling the coupling member 100.

At this time, the rear surface of the position determining protrusion 86 may be formed in a recessed shape to guide the coupling of the coupling member 100, and the portion of the connection unit 85 that is to be coupled to the coupling member 100 is formed in a curved shape so to be recessed toward an inner side.

As the guide unit 80 having the position determining protrusion 86 and the position determining groove 15 guides the coupling position for the coupling member 100, the coupling member 100 may be easily coupled to the connection unit 85 and the frame 10*b*. Thus, the time for the coupling of the coupling member 100 may be reduced, and the efficiency may be increased from the reduced manufacturing time of a product.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine, comprising:

a frame forming an exterior;

an upper cover coupled to an upper portion of the frame and provided with an opening unit to which a laundry is introduced;

an electronic part accommodating plate coupled to an rear portion of the upper cover; and a connection unit provided at the electronic part accommodating plate and extended toward a lower direction from a lower portion of the electronic part accommodating plate, wherein the connection unit is provided at least one connecting hole and at least one reserve connecting hole that is initially closed to be distinguished from the connecting hole.

2. The washing machine of claim 1, wherein the at least one connection unit hole is provided to couple with respect to the frame.

3. The washing machine of claim 2, wherein the at least one reserve connecting hole is provided to couple with the frame when the connecting hole is damaged.

4. The washing machine of claim 2, further comprising a guide unit configured to guide a coupling position of a coupling member that couples the connection unit to the frame.

5. The washing machine of claim 4, wherein the guide unit comprises a position determining protrusion provided at the connection unit and a position determining groove provided at the frame.

6. The washing machine of claim 5, wherein a rear surface of the position determining protrusion is recessed toward an inner side to guide the coupling position of the coupling member, and the position determining groove is coupled to the position determining protrusion in a corresponding manner to each other.

7. The washing machine of claim 5, wherein the position determining protrusion is protruded in a curved shape, and the position determining groove is recessed in a corresponding curved shape to guide a coupling position of the coupling member to couple the connection unit to the frame.

8. The washing machine of claim 1, wherein a rib is provided at an inside of the connection unit to support the electronic part accommodating plate.

9. The washing machine of claim 1, wherein the connection unit is provided at both edges of the electronic part accommodation plate.

10. The washing machine of claim 9, wherein the connection unit is further provided at a central portion of the electronic part accommodating plate.

11. The washing machine of claim 1, wherein the connection unit is integrally injection-molded with the electronic part accommodating plate.

12. A washing machine having a frame forming an exterior and an upper cover, which is coupled to an upper portion of the frame and provided with an opening unit to which a laundry is introduced, the washing machine comprising:

an electronic part accommodating plate coupled to a rear portion of the upper cover, and at least one connection unit provided at the electronic part accommodating plate and extended toward a lower direction from the electronic part accommodating plate, wherein the connection unit is provided at least one connecting hole and at least one reserve connecting hole that is initially closed to be distinguished from the connecting hole.

13. The washing machine of claim 12, wherein the at least one connection unit is provided at both edges of the electronic part accommodating plate.

14. The washing machine of claim 12, wherein the at least one connection unit is provided at a central portion of the electronic part accommodating plate.

15. The washing machine of claim 12, wherein the at least one connection unit is provided at an inside thereof with at least one connection unit hole which is coupled to a coupling member that is configured to couple the electronic part accommodating plate to the frame.

16. The washing machine of claim 15, wherein a position determining protrusion is provided at the connection unit to guide a coupling position of the coupling member that couples the connection unit to the frame, and a position determining groove is provided in the frame to couple the position determining protrusion in a corresponding manner to each other.

17. The washing machine of claim 16, wherein the position determining protrusion is protruded in a curved shape, and the position determining groove is recessed in a corresponding curved shape to guide a coupling position of the coupling member to couple the connection unit to the frame.

18. The washing machine of claim 12, wherein the at least one connection unit is integrally injection-molded with the electronic part accommodating plate.

* * * * *

UNITED STATES PATENT AND TRADEMARK OFFICE

CERTIFICATE OF CORRECTION

PATENT NO. : 8,845,041 B2
APPLICATION NO. : 13/600754
DATED : September 30, 2014
INVENTOR(S) : Ji Il Jung et al.

It is certified that error appears in the above-identified patent and that said Letters Patent is hereby corrected as shown below:

On the Title Page, Column 1, Item [30] (Foreign Application Priority Data), Line 1, After "10-2011-0089427" insert new Line 2, -- Nov. 10, 2011 (KR) ..... 10-2011-0116909 --, therefor.

Signed and Sealed this
Twenty-third Day of December, 2014

Michelle K. Lee

Michelle K. Lee
*Deputy Director of the United States Patent and Trademark Office*